US006302305B1

(12) United States Patent
Bonningue

(10) Patent No.: US 6,302,305 B1
(45) Date of Patent: Oct. 16, 2001

(54) PUMP INTENDED TO BE FITTED TO A CONTAINER

(75) Inventor: Philippe Bonningue, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/650,678

(22) Filed: Aug. 30, 2000

(30) Foreign Application Priority Data

Sep. 7, 1999 (FR) ..... 99 11167

(51) Int. Cl.[7] ..... B67D 5/40
(52) U.S. Cl. ..... 222/380; 222/321.7; 222/341
(58) Field of Search ..... 222/321.1, 321.7, 222/382, 380, 341

(56) References Cited

U.S. PATENT DOCUMENTS 3,489,322 * 1/1970 Ayres ..... 222/341
4,315,582 2/1982 Micallef .
4,396,132 * 8/1983 Christensen ..... 222/1
4,410,107 * 10/1983 Corsette ..... 222/321
4,674,659 6/1987 Micallef .

FOREIGN PATENT DOCUMENTS

WO 97/05043 2/1997 (WO) .

* cited by examiner

*Primary Examiner*—Kevin Shaver
*Assistant Examiner*—F. Nicolas
(74) *Attorney, Agent, or Firm*—Oliff & Berridge, PLC

(57) ABSTRACT

The invention relates to a pump (10) comprising a base part (13) and a telescopic assembly (30) defining a pumping chamber (60). The telescopic assembly comprises at least one outer sleeve (31) and an inner sleeve sliding inside it. The telescopic assembly (30) is arranged in such a way that, on the one hand, when the outer sleeve (31) is moved to reduce the volume of the pumping chamber, the assembly adopts a dispensing configuration and shut-off means (32) shut off the filling orifice (21) and, on the other hand, when the outer sleeve is moved to increase the volume of the pumping chamber, the telescopic assembly adopts its filling configuration and the shut-off means (32) cease to shut off the filling orifice (21).

16 Claims, 3 Drawing Sheets

Figure 1:
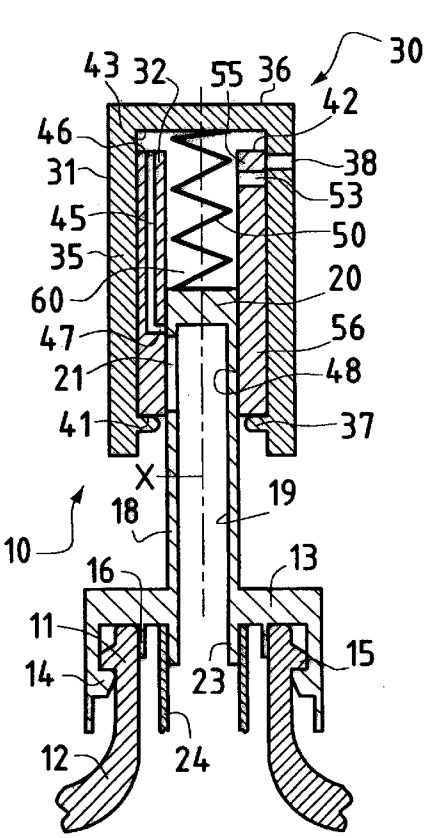

110
180
141
142
158
133
156
131
119
132

110
141
142
170
160
132
156
133
151
150

110
138
136
141
142
160
131
132
156
133
140
137
119

110
136
139
138
170
160
141
142
180
158
131
132
156
155
130
162
133
151
150
137
140
113
119
X
161
115
123
124
116
111
114
112

PUMP INTENDED TO BE FITTED TO A CONTAINER

The present invention relates to a pump intended to be fitted to a container, particularly a container containing a cosmetic product.

The invention is aimed more specifically at providing a new pump which is inexpensive to manufacture and operates reliably.

The pump according to the invention comprises a base part secured to the container and is characterised in that it comprises a telescopic assembly which can move axially with respect to this base part and which defines therewith a variable-volume pumping chamber, the telescopic assembly comprising at least one outer sleeve and an inner sleeve sliding in contact with and inside the former sleeve, these sleeves each comprising a dispensing passage, these dispensing passages communicating with each other when the telescopic assembly is in a dispensing configuration, to then define an outlet passage allowing the product contained in the pumping chamber to be dispensed, the said dispensing passages ceasing to communicate with each other when the telescopic assembly is in a filling configuration, the base part comprising a filling orifice via which the product contained in the container can be drawn up to fill the pumping chamber, the telescopic assembly being arranged in such a way that, on the one hand, when the outer sleeve is moved to reduce the volume of the pumping chamber, the telescopic assembly adopts its dispensing configuration and shut-off means shut off the filling orifice and, on the other hand, when the outer sleeve is moved to increase the volume of the pumping chamber, the telescopic assembly adopts its filling configuration and the shut off means cease to shut off the filling orifice.

Advantageously, the said means of shutting off the filling orifice consist of the radially innermost sleeve. As an alternative, they could comprise a valve element.

In a preferred embodiment, the telescopic assembly has just two sleeves, which means that the pump is relatively simple to manufacture.

Still in a preferred embodiment, the inner sleeve has a delivery passage opening, on the one hand, at one end, via a radial orifice situated facing the filling orifice when the inner sleeve is in a filling position and opening, on the other hand, at another end via an axial orifice, the outer sleeve being capable of shutting off the axial orifice when the outer sleeve is moved in such a way as to reduce the volume of the pumping chamber.

Still in a preferred embodiment, the outer sleeve comprises a top wall capable of shutting off the aforementioned axial orifice.

Still in a preferred embodiment, the inner sleeve can move between the top wall of the outer sleeve and a limit stop provided towards the bottom of the outer sleeve.

Still in a preferred embodiment, the friction between the inner sleeve and the base part is greater than the friction between the outer sleeve and the inner sleeve.

In one alternative form, the telescopic assembly comprises three sleeves.

In this alternative form, the radially innermost sleeve advantageously comprises, on its interior surface, a part capable of shutting off the filling orifice when this sleeve is in a shutting-off position, and a recess capable of allowing the flow of product from the filling orifice when this sleeve is in a filling position.

Still in this alternative form, the intermediate sleeve between the radially innermost sleeve and the outer sleeve can move between a dispensing position in which it rests against a top wall of the outer sleeve, and a filling position in which it rests against a limit stop provided towards the bottom of the outer sleeve.

Still in this alternative form, the friction between the outer sleeve and the intermediate sleeve is less than the friction between the intermediate sleeve and the radially innermost sleeve, and the friction of the radially innermost sleeve on the base part is greater than the friction between the various sleeves of the telescopic assembly.

Advantageously, the base part comprises a hollow shaft equipped with at least one lateral opening defining the filling orifice.

A further subject of the invention is a container equipped with a pump like the aforementioned one.

Figure 2:
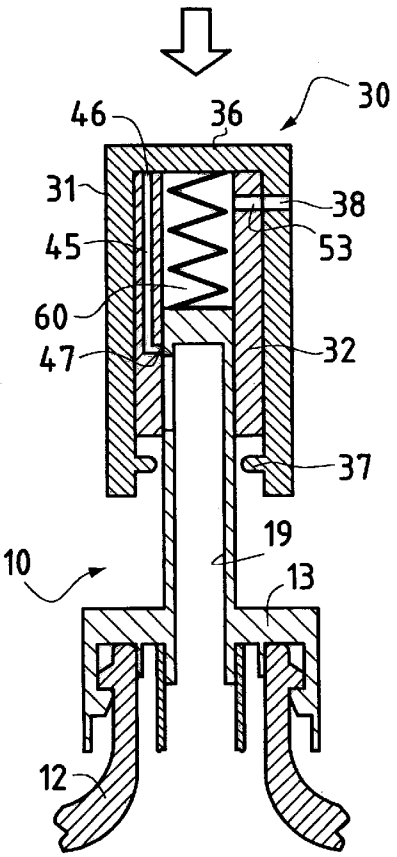
Figure 3:
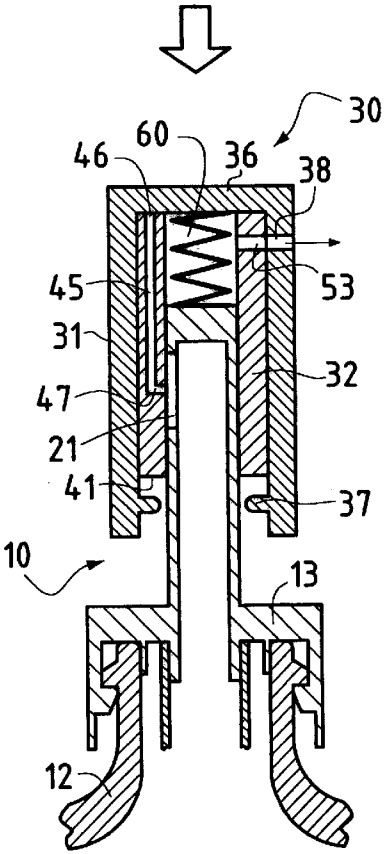
Figure 4:
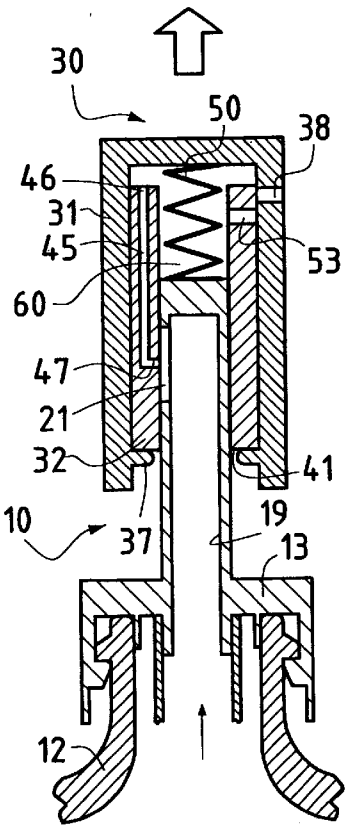
Figures 5, 6, 7, 8:
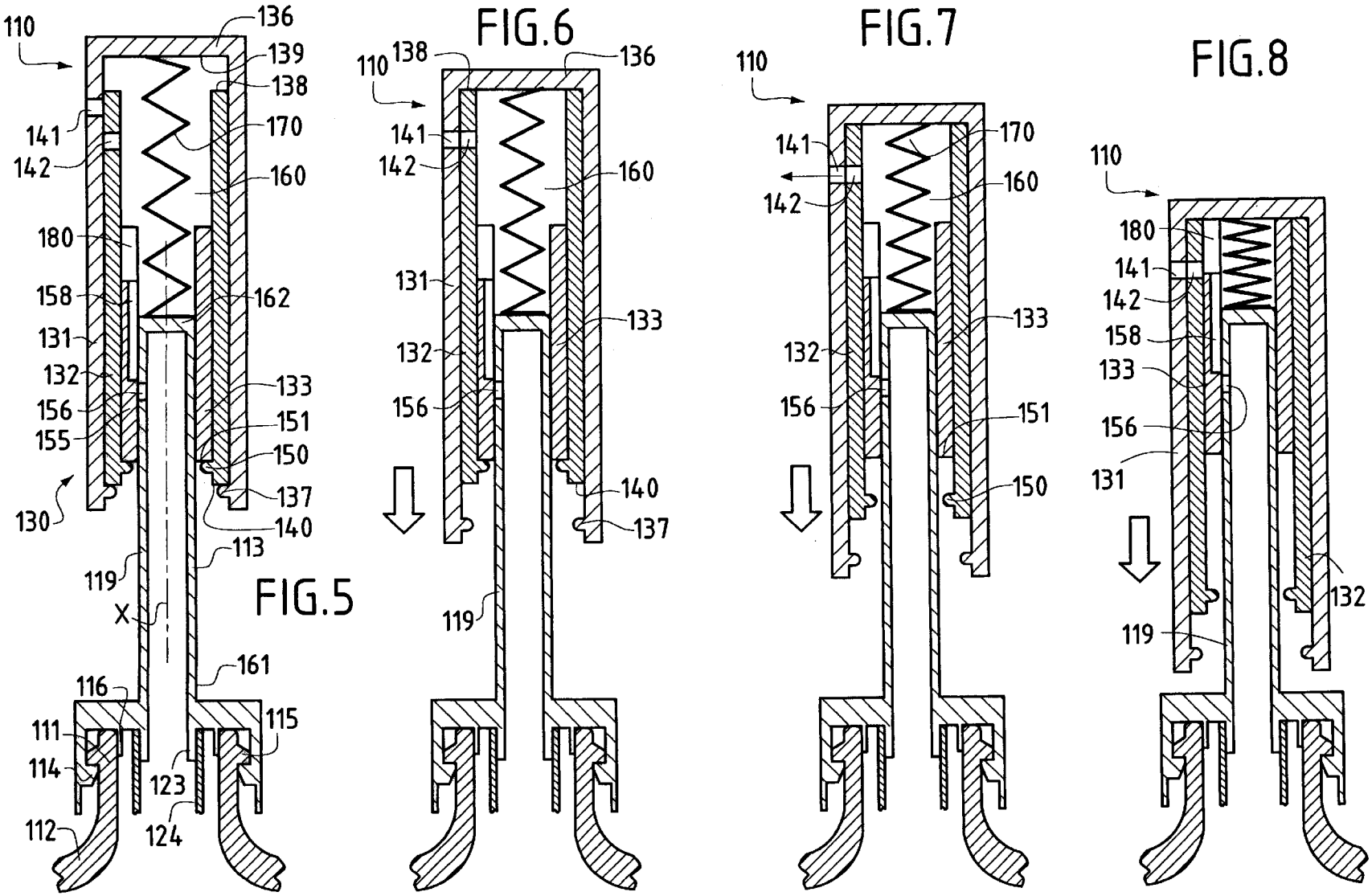

The invention will be better understood from reading the detailed description which will follow of some non-limiting exemplary embodiments, and from examining the appended drawing in which:

FIG. 1 is a diagrammatic view in axial section of a pump according to a first exemplary embodiment of the invention, FIGS. 2 to 4 are views similar to FIG. 1, illustrating the operation of the pump of FIG. 1, FIG. 5 is a diagrammatic view in axial section of a pump according to an alternative form of the invention, and FIGS. 6 to 12 are views similar to FIG. 5, illustrating the operation of the pump of FIG. 5.

The pump 10 depicted in FIGS. 1 to 4 is intended to be mounted on the neck 11, of axis X, of a container 12 and comprises a base part 13 provided, towards its bottom, with a mounting skirt 14 shaped to snap-fasten over an annular bulge 15 of the neck 11, a sealing skirt 16 shaped to fit, with sealing, inside the neck 11, and a nozzle 23 for mounting a dip tube 24.

At its upper part, the base part 13 has a hollow shaft 18, comprising a side wall 19, which is cylindrical of axis X, closed at its upper end by a top wall 20.

Passing through the side wall 19, in its upper part, is a filling orifice 21 through which the product from the container can flow, as will be specified hereinafter.

The pump 10 also comprises a telescopic assembly 30 made up of an outer sleeve 31 and an inner sleeve 32, which can slide one with respect to the other, the inner sleeve 32 also being able to slide on the side wall 19 of the hollow shaft 18.

The outer sleeve 31 acts as a push-button and comprises a tubular wall 35 of axis X, closed at its upper end by a top wall 36 perpendicular to the axis X.

A limit stop 37 projecting radially towards the inside is provided near the lower end of the tubular wall 35, to cause the inner sleeve 32 to move upwards.

A radial hole 38 forming a dispensing passage passes through the tubular wall 35 near the top wall 36.

The inner sleeve 32 is open at both axial ends and is able to move inside the outer sleeve 31 between a position in which it rests via its lower end 41 against the aforementioned limit stop 37 and a position in which it rests via its upper edge face 42 against the lower face 43 of the top wall 36.

The inner sleeve 32 comprises an interior passage 45, made in its thickness, opening at one end via an axial orifice 46 on to its upper edge face 42 and, at the other end, via its radial orifice 47 on to its radially interior surface 48.

The inner sleeve 32 also comprises a radial hole 53, forming a dispensing passage.

This hole 53 can come to face the hole 38 in the outer sleeve 31 when the inner sleeve 32 is resting via its upper end 42 against the interior face 43 of the top wall 36 of the outer sleeve 31, as depicted in FIG. 2.

A helical coil spring 50, working in compression, is placed inside the inner sleeve 32, rests at its lower end on the top wall 20 of the hollow shaft 18, and at its upper end on the lower face 43 of the top wall 36 of the outer sleeve 31.

As an alternative, the spring 50 could be placed between the outer sleeve 31 and the base part 31, around the hollow shaft 18.

The friction between the inner sleeve 32 and the hollow shaft 18 is greater than the friction there is between the inner sleeve 32 and the outer sleeve 31.

When the inner sleeve 32 rests against the limit stop 37 of the outer sleeve 31, as depicted in FIG. 1, the holes 38 and 53 are offset and do not communicate, and the upper part 55 of the inner sleeve 32, which part is located above the hole 53, shuts off the hole 38.

When the pump 10 is in its configuration of rest, depicted in FIG. 1, the lower part 56 of the inner sleeve 32, which part is located below the orifice 47, shuts off the filling orifice 21.

With the hollow shaft 18, the telescopic assembly 30 defines a variable-volume pumping chamber 60.

More specifically, this pumping chamber 60 is delimited at the top by the top wall 36, at the bottom by the top wall 20, and laterally by the inner sleeve 32 and that part of the outer sleeve 31 which is located above the inner sleeve 32.

The way in which the pump 10 operates is as follows.

To dispense some product, the user presses on the top wall 36 of the outer sleeve 31 to move the latter downwards, as illustrated in FIG. 2.

The inner sleeve 32 remains motionless first of all, because the forces of friction between the inner sleeve 32 and the hollow shaft 18 are greater than those which there are between the outer sleeve 31 and the inner sleeve 32.

The relative movement of the outer sleeve 31 with respect to the inner sleeve 32 continues until the inner sleeve 32 comes to bear, via its upper edge face 42, against the lower face 43 of the top wall 36.

The axial orifice 46 is then shut off by the top wall 36 whereas the holes 38 and 53 are practically aligned with one another and form an outlet passage, allowing the product contained in the pumping chamber 60 to be dispensed, as illustrated in FIG. 3.

The inner sleeve 32 is then made to move downwards together with the outer sleeve 31, against the return action of the spring 50, to dispense the product contained in the pumping chamber 60.

When the user releases the outer sleeve 31, the latter begins by moving relative to the inner sleeve 32, the latter remaining motionless given its friction against the hollow shaft 18, until such time as the limit stop 37 comes up against the lower end 41 of the inner sleeve 32, as depicted in FIG. 4.

The axial orifice 46 is uncovered and air can be taken in while the holes 53 and 38 are in communication.

Thereafter, the holes 53 and 38 find themselves completely offset and no longer communicate.

As the outer sleeve 31 continues its return upwards movement under the return action of the spring 50, and carries the inner sleeve 32 along with it because of the limit stop 37, the volume of the pumping chamber 60 increases and the product is drawn in via the interior passage 45, the radial orifice 47 being open facing the filling orifice 21.

The product from the container flows through the interior passage 45 as long as the radial orifice 47 of the inner sleeve 32 is in communication with the filling orifice 21.

The height of the filling orifice 21 is chosen such that the filling orifice 21 and the radial orifice 47 communicate when the outer sleeve 31 is fully depressed and as it moves back up, until such time as it is about to reach its up position.

A limit stop, which has not been depicted in order to make the drawing clearer, limits the upwards travel of the inner sleeve 32 with respect to the hollow shaft 18.

The inner sleeve 32 and the outer sleeve 31 are kept in predetermined angular positions about the axis X by rotation-indexing means which have not been depicted in order to make the drawing clearer.

FIGS. 5 to 12 depict a pump 110 comprising a base part 113 which comprises a hollow shaft 119 of axis X.

The hollow shaft 119 comprises a side wall 161 through which a filling orifice 156 passes, and a top wall 162.

The pump 110 also comprises a telescopic assembly 130, which comprises an outer sleeve 131, an intermediate sleeve 132, and an inner sleeve 133.

The outer sleeve 131 is closed at its upper end by a top wall 136 and near its lower end comprises a limit stop 137 directed radially inwards.

The intermediate sleeve 132 is open at both axial ends and can move axially inside the outer sleeve 131 between a position in which it rests via its upper end 138 against the lower face 139 of the top wall 136, and a position in which it rests via its lower end 140 on the limit stop 137.

The outer sleeve 131 comprises a hole 141, forming a dispensing passage, and the intermediate sleeve 132 comprises a hole 142 forming a dispensing passage, which can be positioned facing the hole 141 when the intermediate sleeve 132 is resting against the top wall 136, as illustrated in FIG. 2, so as to form an outlet passage via which the product contained in the pumping chamber 160 is dispensed.

The intermediate sleeve 132 comprises, near its lower end, an inwardly-facing limit stop 150 against which the lower end 151 of the inner sleeve 133 can come to rest.

When the intermediate sleeve 132 is resting against the limit stop 137, the holes 141,142 are not in communication, the hole 141 being shut off by the upper part of the intermediate sleeve 132, which part is located above the hole 142.

The inner sleeve 133 is open at both axial ends and comprises a lower part 155 capable of shutting off the filling orifice 156 of the hollow shaft 119 and an upper part which has a recess 158.

The upper part of the inner sleeve 133 has perforations 180, the function of which will be specified later on.

A return spring 170 is located inside the pumping chamber 160, resting at its upper end against the top wall 136 and at its lower end against the top wall 162 of the hollow shaft 119.

The friction of the inner sleeve 133 on the hollow shaft 119 is greater than the friction of the intermediate sleeve 132 on the inner sleeve 133, which is itself greater than the friction of the outer sleeve 131 on the intermediate sleeve 132.

The way in which the pump 110 works is as follows.

Initially, the holes 141 and 142 are offset and the pumping chamber 170 is isolated from the outside, as can be seen in FIG. 5.

The lower part 155 of the inner sleeve 133 shuts off the filling orifice 156.

When the user presses on the outer sleeve 131, the latter begins to move relative to the intermediate sleeve 132 and the holes 141 and 142 communicate, as depicted in FIG. 6.

The inner sleeve 133 and intermediate sleeve 132 have remained motionless.

As the user continues to press on the outer sleeve 131, the volume of the pumping chamber 160 decreases and the product is dispensed through the outlet passage formed by the holes 141 and 142, as illustrated in FIG. 7.

The intermediate sleeve is then resting via its upper end 138 on the top wall 136.

Once the outer sleeve 131 has completed a certain amount of downwards travel, the inner sleeve 133 comes to rest on the top wall 136, as illustrated in FIG. 8.

The perforations 180 make it possible to prevent the inner sleeve 133 from impeding the dispensing of product through the holes 141 and 142.

Figure 9:
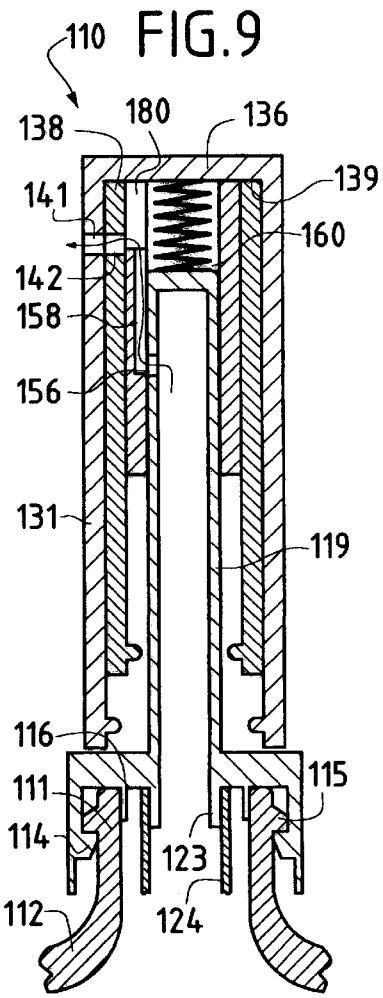

Next, as the user continues to press on the outer sleeve 131, the inner sleeve 133 is moved relative to the hollow shaft 119 and the recess 158 positions itself facing the filling orifice 156, as illustrated in FIG. 9.

Air may be taken in through the holes 141, 142, the recess 158 and the filling orifice 156.

Figure 10:
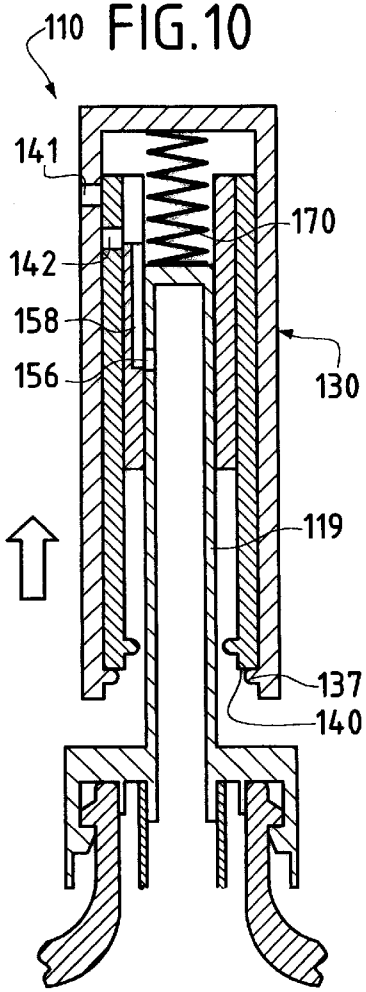

When the user releases the outer sleeve 131, the latter moves relative to the intermediate sleeve 132 under the return action of the return spring 170 until the limit stop 137 comes to rest against the lower end 140 thereof, as illustrated in FIG. 10.

In this configuration of the telescopic assembly 130, the holes 141 and 142 are no longer in communication.

Figure 11:
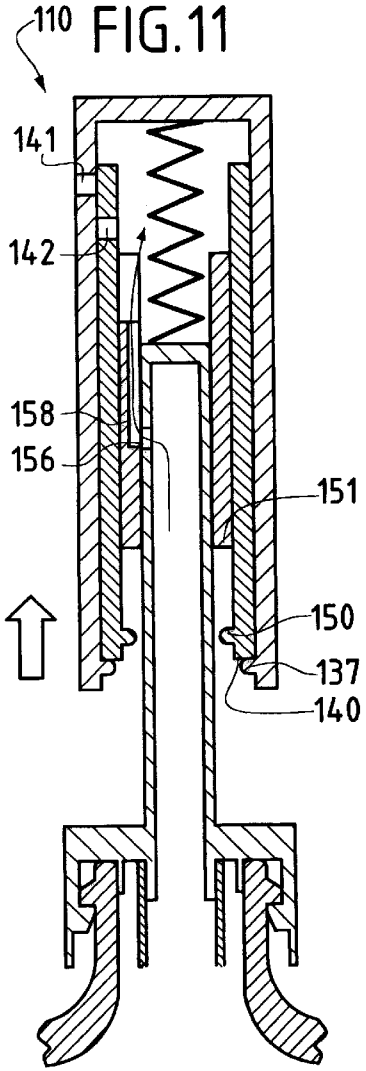

The outer sleeve 131 and intermediate sleeve 132 then move back upwards again together, which causes the product contained in the hollow shaft 119 to be drawn into the pumping chamber, this product flowing through the filling orifice 156 and along the recess 158, as illustrated in FIG. 11.

Figure 12:
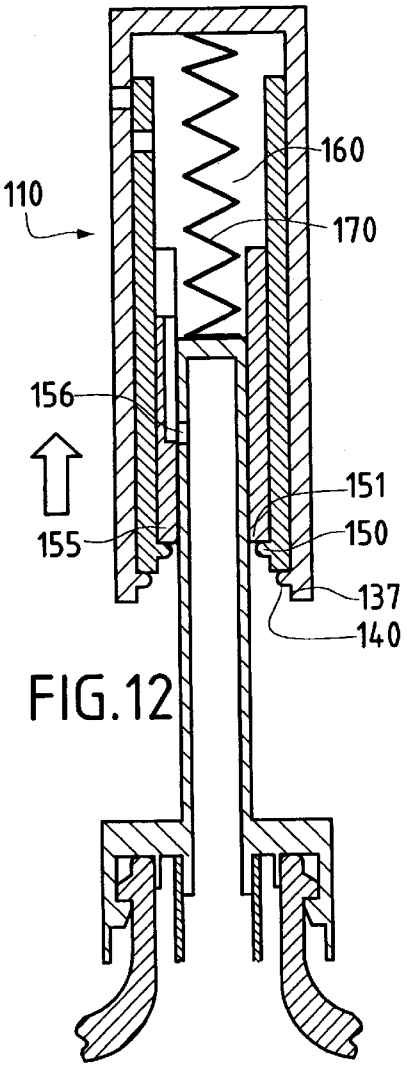

The return upwards movement of the outer sleeve 131 and intermediate sleeve 132 continues until the inner sleeve 133 comes to rest against the limit stop 150 of the intermediate sleeve 132, as depicted in FIG. 12.

The inner sleeve 133 is then made to move upwards, its lower part 155 shutting off the filling orifice 156.

This constitutes a return to the configuration of FIG. 5.

Of course, the invention is not restricted to the exemplary embodiment which has just been described.

In particular, the shape of the telescopic assembly and that of the base part can be altered according to the nature of the product and the amount to be dispensed.

Furthermore, the return spring can be mounted not in the pumping chamber but between the outer sleeve and the base part.

What is claimed is:

1. A pump to be fitted to a container, the pump comprising a base part secured to the container, and a telescopic assembly which moves axially with respect to the base part and which defines therewith a variable-volume pumping chamber, the telescopic assembly comprising at least one outer sleeve and an inner sleeve sliding in contact with and inside the at least one outer sleeve, the inner and outer sleeves each comprising a dispensing passage, the dispensing passages communicating with each other when the telescopic assembly is in a dispensing configuration to then define an outlet passage allowing product contained in the pumping chamber to be dispensed, the dispensing passages ceasing to communicate with each other when the telescopic assembly is in a filling configuration, the base part comprising a filling orifice through which the product contained in the container can be drawn up to fill the pumping chamber, the telescopic assembly being arranged such that, when the outer sleeve is moved to reduce the volume of the pumping chamber, the telescopic assembly adopts the dispensing configuration and shutoff means shuts off the filling orifice and, when the outer sleeve is moved to increase the volume of the pumping chamber, the telescopic assembly adopts its filling configuration and the shut-off means ceases to shut off the filling orifice.

2. The pump according to claim 1, wherein said shut-off means comprises a radially innermost sleeve.

3. The pump according to claim 1, wherein the telescopic assembly has just two sleeves.

4. The pump according to claim 1, wherein the telescopic assembly comprises a radially innermost sleeve, an outer sleeve, and an intermediate sleeve between the radially innermost sleeve and the outer sleeve.

5. The pump according to claim 1, wherein the base part comprises a hollow shaft equipped with at least one lateral opening defining the filling orifice.

6. A container equipped with a pump as defined in claim 1.

7. The pump according to claim 2, wherein the friction between the inner sleeve and the base part is greater than the friction between the outer sleeve and the inner sleeve.

8. The pump according to claim 3, wherein the inner sleeve has a delivery passage opening, at one end, via a radial orifice situated facing the filling orifice when the inner sleeve is in a filling position and opening at another end via an axial orifice, the outer sleeve being capable of shutting off the axial orifice when the outer sleeve is moved to reduce the volume of the pumping chamber.

9. The pump according to claim 8, wherein the outer sleeve comprises a top wall capable of shutting off the axial orifice.

10. The pump according to claim 9, wherein the inner sleeve can move between the top wall and a limit stop provided towards the bottom of the outer sleeve.

11. The pump according to claim 4, wherein the radially innermost sleeve comprises, on its interior surface, a part capable of shutting off the filling orifice when the radially innermost sleeve is in a shutting-off position, and a recess capable of allowing the flow of product from the filling orifice when the radially innermost sleeve is in a filling position.

12. The pump according to claim 11, wherein the intermediate sleeve between the radially innermost sleeve and the outer sleeve can move between a dispensing position in which the intermediate sleeve rests against a top wall of the outer sleeve, and a filling position in which the intermediate sleeve rests against a limit stop provided towards the bottom of the outer sleeve.

13. The pump according to claim 12, wherein friction between the outer sleeve and the intermediate sleeve is less than friction between intermediate sleeve and the radially innermost sleeve.

14. The pump according to claim 13, wherein friction of the radially innermost sleeve on the base part is greater than friction between the sleeves of the telescopic assembly.

15. A pump to be fitted to a container, the pump comprising a base part secured to the container, and a telescopic assembly which moves axially with respect to the base part and which defines therewith a variable-volume pumping chamber, the telescopic assembly comprising one outer sleeve and an inner sleeve in sliding contact with the outer sleeve, the inner and outer sleeves each comprising a dispensing passage, the dispensing passages communicating with each other when the telescopic assembly is in a dispensing configuration to then define an outlet passage allowing product contained in the pumping chamber to be dispensed, the dispensing passages ceasing to communicate with each other when the telescopic assembly is in a filling configuration, the base part comprising a filling orifice through which product contained in the container can be drawn up to fill the pumping chamber, the telescopic assembly being arranged such that when the outer sleeve is moved to reduce the volume of the pumping chamber, the telescopic assembly adopts the dispensing configuration and the outer and inner sleeves shut off the filling orifice, and when the outer sleeve is moved to increase the volume of the pumping chamber, the telescopic assembly adopts the filling configuration and the outer and inner sleeves no longer shut off the filling orifice.

16. A pump to be fitted to a container, the pump comprising a base part secured to the container, and a telescopic assembly which moves axially with respect to the base part and which defines therewith a variable-volume pumping chamber, the telescopic assembly comprising one outer sleeve, an intermediate sleeve in sliding contact with the outer sleeve and an inner sleeve in sliding contact with said intermediate sleeve, the outer and intermediate sleeves each comprising a dispensing passage, the dispensing passages communicating with each other when the telescopic assembly is in a dispensing configuration to then define an outlet passage allowing the product contained in the pumping chamber to be dispensed, the dispensing passages ceasing to communicate with each other when the telescopic assembly is in a filling configuration, the base part comprising a filling orifice through which the product contained in the container can be drawn up to fill the pumping chamber, the telescopic assembly being arranged such that, when the outer sleeve is moved to reduce the volume of the pumping chamber, the telescopic assembly adopts the dispensing configuration and the inner sleeve shuts off the filling orifice and, when the outer sleeve is moved to increase the volume of the pumping chamber, the telescopic assembly adopts the filling configuration and the inner sleeve no longer shuts off the filling orifice.

* * * * *